United States Patent [19]

Howell

[11] Patent Number: 4,698,607

[45] Date of Patent: Oct. 6, 1987

[54] HIGH SPEED CONTACT DRIVER FOR CIRCUIT INTERRUPTION DEVICE

[75] Inventor: Edward K. Howell, Simsbury, Conn.

[73] Assignee: General Electric Company, New York, N.Y.

[21] Appl. No.: 919,415

[22] Filed: Oct. 16, 1986

[51] Int. Cl.[4] ..... H01H 53/00

[52] U.S. Cl. ..... 335/195; 335/16; 335/147; 200/147 R

[58] Field of Search ..... 335/16, 195, 147; 200/147 R

[56] References Cited

U.S. PATENT DOCUMENTS

| | | | |
|---|---|---|---|
| 1,720,566 | 7/1929 | Pestarini . | |
| 3,002,065 | 9/1961 | La Tour, Jr. | 200/87 |
| 3,168,626 | 2/1965 | Patrick | 200/87 |
| 3,215,796 | 11/1965 | Leisi | 200/91 |
| 4,039,983 | 8/1977 | Terracol et al. | 335/16 |
| 4,598,187 | 7/1986 | Howell | 200/147 |
| 4,646,041 | 2/1987 | Howell | 335/147 |

OTHER PUBLICATIONS

U.S. Patent Applic. Ser. No. 610,947, filed May 16, 1984, E. K. Howell, "Solid State Current Limiting Circuit Interrupter".

U.S. Patent Applic. Ser. No. 770,931, filed 8/30/84, E. K. Howell, "Low Voltage Vacuum Circuit Interrupter".

U.S. Patent Applic. Ser. No. 814,865, filed 12/30/85, E. K. Howell, "High Speed Contact Driver for Circuit Interruption Device".

*Primary Examiner*—E. A. Goldberg

*Assistant Examiner*—Lincoln Donovan

*Attorney, Agent, or Firm*—Richard A. Menelly; Walter C. Bernkopf; Fred Jacob

[57] ABSTRACT

A bridging contact is arranged across two fixed contacts with a pair of parallel, closely spaced conductors serving as the bridging contact carrier. The conductors each form a pair of upper and lower links joined by means of a toggle pivot pin and are refrained from movement by means of a pair of tension springs. A high current pulse in opposite direction within the parallel conductors generates electromagnetic forces which propels the conductors apart. The bridging contact carried by the parallel conductors is thereby rapidly driven out of contact relation with the fixed contacts to interrupt the circuit.

19 Claims, 3 Drawing Figures

29
28
44
27
35
30
24
45
26
21
40
33
51
50
33A
33B
50
51
23
18
34
34B
50
51
34A
50
41
37
20
12
17
36
14
11
16
10

HIGH SPEED CONTACT DRIVER FOR CIRCUIT INTERRUPTION DEVICE

BACKGROUND OF THE INVENTION

The advent of a practical solid state current limiting interrupter such as described in U.S. patent application Ser. No. 610,947 filed May 16, 1984 in the name of E.K. Howell has provided a synergistic relationship between the circuit interrupter contacts and the contact operating mechanism. By employing a solid state switch in parallel with the contacts, the current is diverted away from the contacts immediately upon contact separation to substantially reduce the arcing energy and hence essentially eliminate the deleterious arcing effect on the contacts. This in turn allows the contacts to be made much smaller and hence reduces both their thermal and inertial mass. The reduction in the inertial mass in turn allows the contacts to be more rapidly separated and hence allows circuit interruption during the early stages of the current wave form. The lower contact inertial mass allows the use of a bridging contact between a pair of fixed contacts such as described in U.S. Pat. No. 4,598,187, issued July 1, 1986, entitled "Current Limiting Circuit Breaker" in the name of E.K. Howell. The bridging contact arrangement provides for a further reduction in the mass of the contacts such that even more rapid contact separation can be attained and allows the current interruption to occur at the correspondingly earlier stages of the current waveform.

U.S. patent application Ser. No. 814,865, filed Dec. 30, 1985 and entitled "High Speed Contact Driver For Circuit Interruption Device", describes an extremely fast contact driver utilizing a balanced cantilever spring and a pair of spaced parallel conductors arranged to drive a bridging contact away from a pair of fixed contacts. The conductors are spaced within a pair of magnetic plates to enhance the electromagnetic repulsion generated between the conductors when a high current pulse is applied.

The aforementioned Patent Applications are incorporated herein for reference purposes and should be reviewed for a good description of the operation of a solid state switch for circuit interruption as well as for describing the configuration of a bridging contact arrangement. The instant invention is directed toward a high speed contact driver for rapidly separating a bridging contact from a pair of fixed contacts similar to that described in the latter referenced patent application Ser. No. 814,865.

U.S. Pat. No. 3,215,796 in name of Bruno Leisi, discloses the idea of utilizing line current to produce a varying magnetic field arranged around a pair of spaced parallel conductors to induce opposing currents within the conductors to drive the conductors apart and to separate movable contacts from associated fixed contacts.

U.S. Pat. No. 3,168,626 in the name of Richard Patrick, discloses a fuse utilizing the repulsive forces developed by fault currents flowing in opposite directions through closely spaced, parallel fuse links to sever one or both links and thus interrupt the faulted circuit.

U.S. Pat. No. 3,002,065 in the name of John LaTour, Jr., discloses the use of excessive line currents flowing in opposite direction through conductive columns to repulse one of the columns and thus provide a shunt path to protect a meter.

U.S. Pat. No. 1,720,566 in the name of Joseph Pestarini discloses a circuit controlling device which utilizes a magnetic force to enhance the electromagnetic separation of a bridging contact from a pair of fixed contacts.

U.S. Pat. No. 4,039,983 in the names of Claude Terracol et al. discloses a high speed circuit interrupter having both main contacts and arcing contacts. The main contacts employ a bridging contact for operation and the arcing contacts utilize electromagnetic forces to hold the arcing contacts closed for a short period of time after separation of the bridging contact from the main contact.

The purpose of the instant invention is to provide a high speed contact driver arrangement wherein a high current pulse is employed to electromagnetically repulse a pair of conductors serving as a contact carrier for a bridging contact arranged across a pair of contacts within a protected circuit for extremely fast circuit interruption upon command.

SUMMARY OF THE INVENTION

The invention comprises a high speed contact driver consisting of a pair of parallel-spaced conductors each comprising an upper and lower link pivotally connected by means of pivot pins. A bridging contact arranged at the ends of the linked conductors is biased into good electrical contact relation with a pair of stationary contacts by means of a pair of tension springs. A pulse of current applied to the link conductors electromagnetically repels the conductors rotating their links about their pivots and rapidly lifting the bridging contact away from the stationary contacts.

DESCRIPTION OF THE PREFERRED EMBODIMENT

Figure 1:
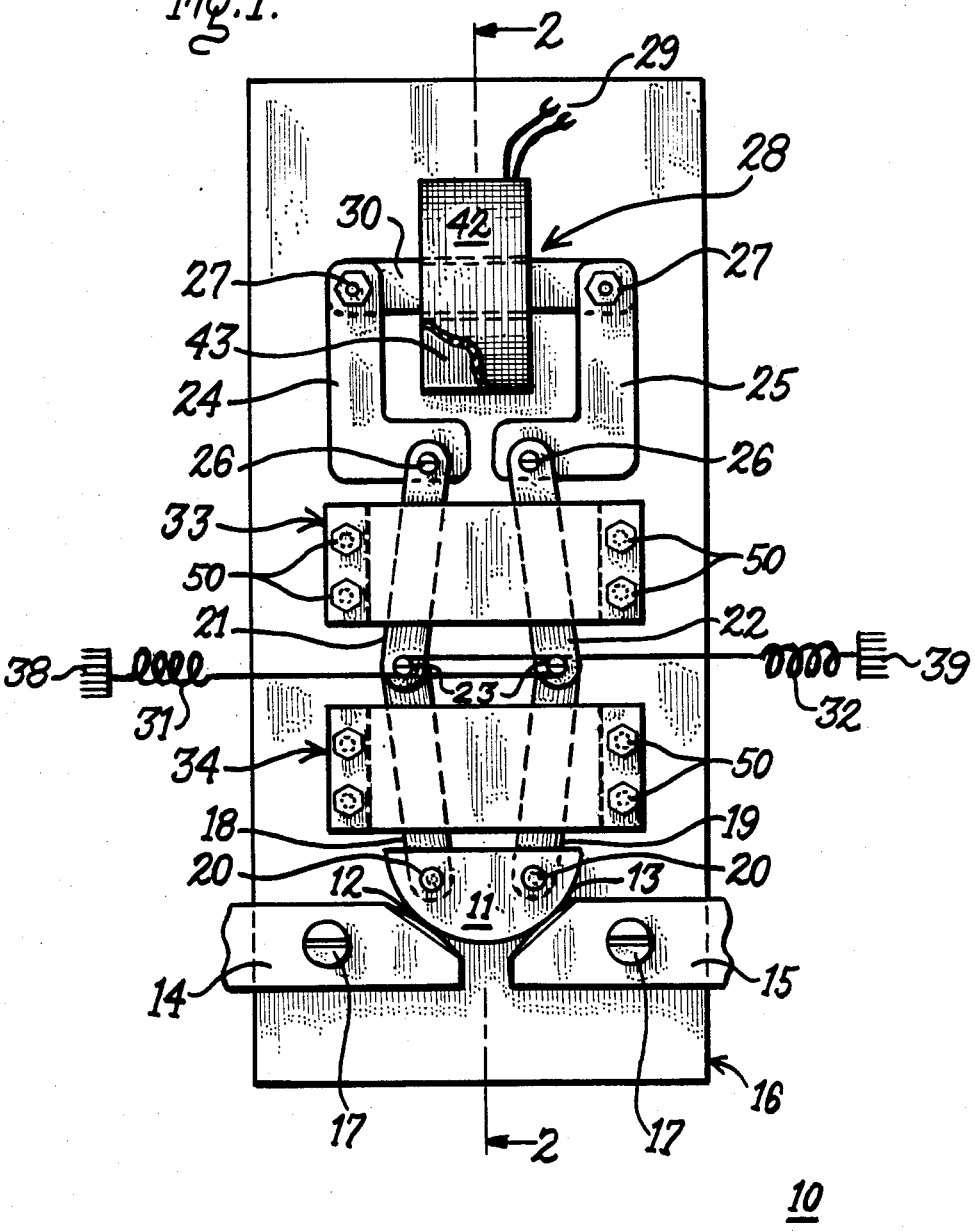
FIG. 1 is a front view of the high speed contact driver according to the invention with the contacts in a closed condition.
Figure 3:
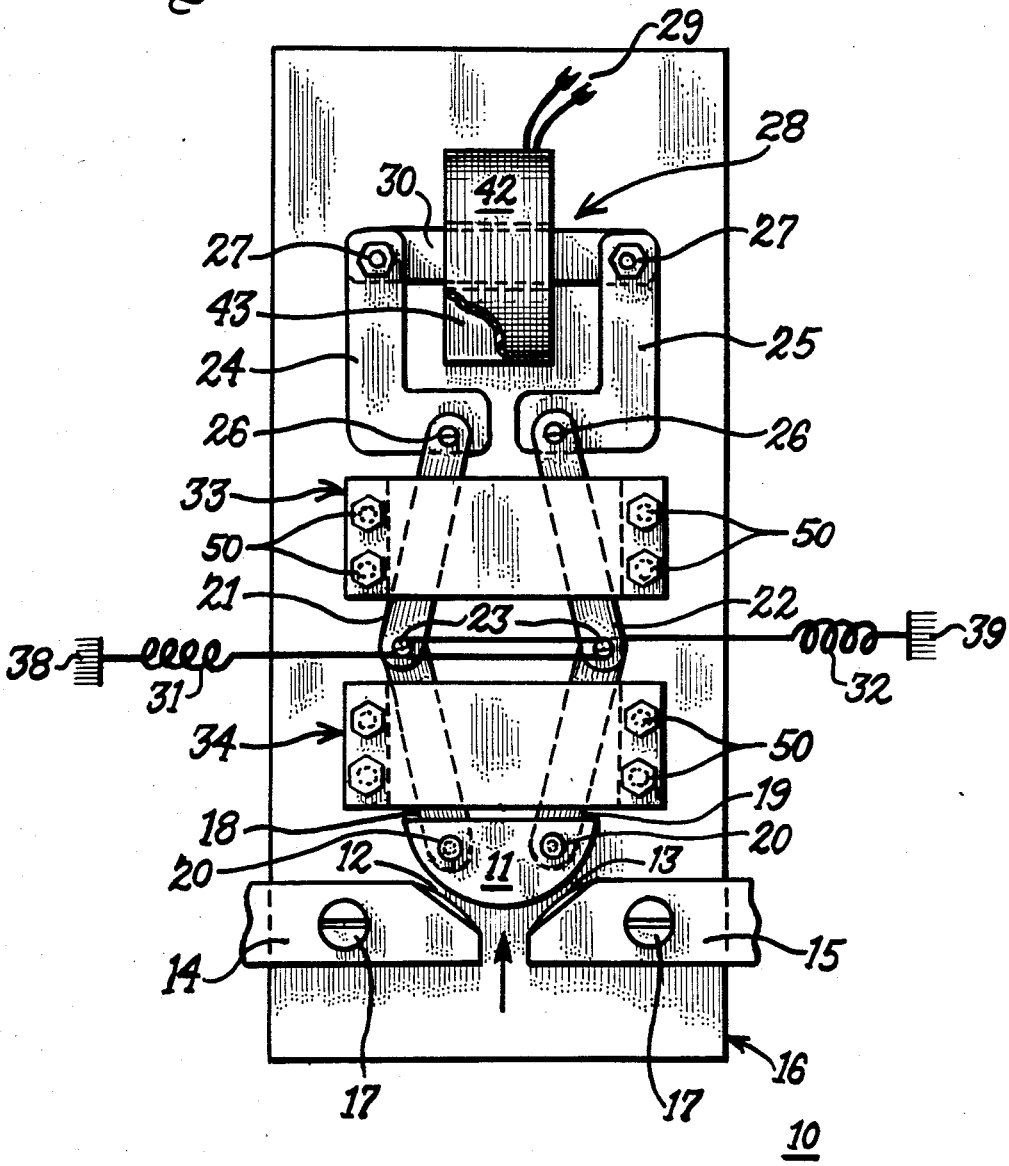
FIG. 3 is a front view of the high speed contact driver of FIG. 1 with the contacts in an open condition.

The high speed contact driver of the invention is depicted at 10 in FIGS. 1 and 3 wherein a bridging contact 11 is arranged across a pair of fixed contacts 12, 13 formed on the sloped ends of a pair of bar conductors 14, 15. The bar conductors are attached to an insulated support 16 by means of a pair of bolts 17 as indicated. Suitable materials for the insulated support are "Noryl", which is a tradename of General Electric Company for a modified polyphenylene, and "Valox", a registered tradename of General Electric Company for polybutylene terepthalate. The bar conductors 14, 15 comprise tin-plated copper and the fixed contacts 12, 13 can comprise a silver-silver tungsten compound as generally employed for residential and industrial circuit interruption devices. To substantially increase the operating life of both the fixed and bridging contacts, the composition described in U.S. Pat. No. 4,607,148, entitled "Change Of State Contact Material For Electric Circuit Interrupters", can also be employed. When the high speed contact driver is contained within an inert gas or evacuated environment, such as described in U.S. patent application Ser. No. 770,931, filed Aug. 30, 1985 and entitled "Low Voltage Vacuum Circuit Interrupter", the materials for both the fixed and bridging contacts can comprise copper or aluminium. The sloped edges of the bar conductors 14, 15, for example, can comprise the fixed contacts without any silver material required. The bridging contact is attached to one end of a pair of lower links 18, 19 by means of pins 20 and the other ends of the lower links are pivotally attached by pins 23 to a pair of upper links 21, 22. The upper links 21, 22 are in turn pivotally connected with a pair of L-shaped conductors 24, 25 by means of pins 26 and are arranged such that the upper and lower links freely pivot about their pins. The L-shaped conductors are attached to the insulative support by means of bolts 27 to support the upper and lower links as well as to support a transformer 28. The secondary winding of the transformer consists of a crosspiece 30 which connects across the opposite ends of the L-shaped conductors and which is attached thereto by means of the same bolts 27. The primary winding 42 of the transformer is arranged around a torroidal core 43 and is electrically connected with a current source (not shown) by means of primary winding leads 29. A pair of tension springs 31, 32 are attached to the toggle pins 23 at one end and are attached to a pair of supports 38, 39 on opposite sides of the insulative support 16. The distance between bolts 17 and 27 is arranged such that the upper and lower links are slightly bowed away from each other in the vertical plane, as depicted in FIG. 1. This results in a force vector generated by the attached bridging contact 11 on the fixed contacts 12, 13, which is approximately ten times greater than the spring force exerted by springs 31, 32 on the upper and lower links in the horizontal plane, as viewed in FIG. 1. The electromagnetic repulsion force exerted between the upper and lower links, when a current pulse is applied to the transformer, is concentrated in the immediate vicinity of the upper and lower links by means of a pair of upper and lower pole pieces 33, 34. When such a current pulse is applied to the transformer, the upper and lower links are rapidly repulsed to the position indicated in FIG. 3, thereby rapidly driving the bridging contact to the open position, also shown in FIG. 3. The positioning of tension springs 31, 32 at the pivotal points of connection between the upper and lower links, allows the electromagnetic force to operate against a relatively small spring force provided by means of springs 31, 32, while the contact force exerted between the bridging and the fixed contacts is substantially higher. This arrangement improves over the earlier high speed contact driver described within referenced U.S. patent application Ser. No. 814,865 by eliminating the heavy contact spring and the cantilevered mass arrangement described therein.

Figure 2:
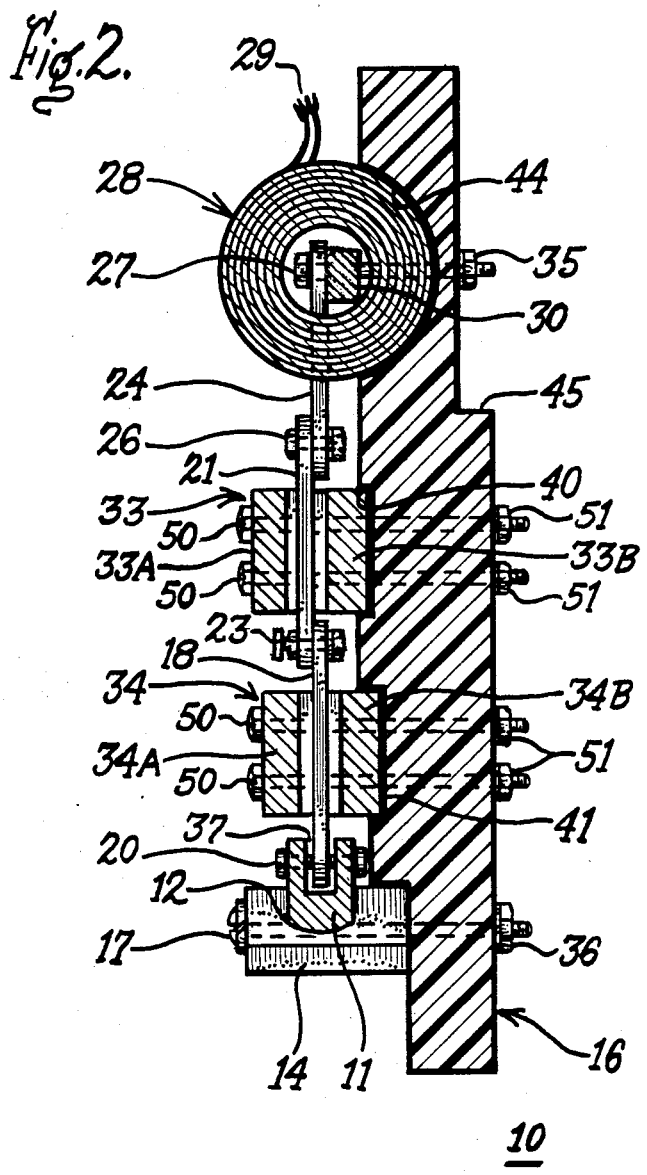
FIG. 2 is a side sectional view of the contact driver of FIG. 1 depicted in the plane 2-2.

Referring now to FIG. 2, the high speed contact driver 10 is shown completely contained on the insulative support 16 with the transformer 28 fitted within arcuate recess 44 formed within the support and retained by means of bolts 27, which pass through the L-shaped conductor 24 and the crosspiece 30 on the front of the support and attach thereto by means of nuts 35 on the back side of the support which are arranged within an offset 45 formed within the insulative support. The upper pole pieces 33 comprise a pair of front and back pieces 33A, 33B joined at each end to form a "slot motor", as so defined within the circuit protection industry. The upper pole 33 is held to the front surface of the insulative support and attached thereto by means of bolts 50 and nuts 51. The lower pole pieces 34 comprise a pair of front and back pieces 34A, 34B that are similarly arranged such that the pole 34 is affixed to the front surface of the insulative support. The bridging contact 11 has a U-shaped slot 37 formed therein to facilitate the connection of the lower links 18, 19. As described earlier, the bar conductors, as indicated at 14, are attached to the insulative support by means of bolts 17 extending through the support and attached to the back surface thereof by means of nuts 36.

It is thus shown that a high speed contact driver in accordance with the invention is completely supported by means of an insulative support which completely houses the transformer and the upper and lower links as well as the bar conductors that carry the fixed contacts.

Having thus described my invention, what I claim as new and desire to secure by Letters Patent is:

1. A contact driver comprising:

a bridging contact arranged across a pair of fixed contacts to allow electric current transport between said fixed contacts;

a first pair of conductor links pivotally attached at one end to said bridging contact and a second pair of conductor links pivotally attached at one end to said first conductor links and at their opposite ends to a pair of fixed conductors;

a first and a second spring, said first spring connected to one of said first and second conductor links and said second spring connected to the other of said first and second conductor links to hold said bridging contact in electrical connection between said pair of fixed contacts; and means for applying a current pulse to said fixed conductors and electromagnetically repelling said first and second pair of conductor links and lifting said bridging contact out of electrical circuit relation with said fixed contacts.

2. The contact driver of claim 1 wherein said current pulse means includes a current transformer.

3. The contact driver of claim 1 further including a first pair of magnetic plates arranged on both sides of said first link conductors and a second pair of magnetic plates arranged on both sides of said second link conductors to enhance electromagnetic repulsion between said first and second pair of link conductors.

4. The contact driver of claim 2 wherein said current transformer includes a multi-turn primary winding and a single turn secondary winding arranged around an apertured magnetic core.

5. The contact driver of claim 4 wherein said secondary winding comprises a conductive strap interconnecting said pair of fixed conductors.

6. The contact driver of claim 4 wherein said conductive strap passes through an aperture in said apertured core.

7. The contact driver of claim 1 wherein said pair of first and second link conductors are arranged side by side in the same plane.

8. The contact driver of claim 7 wherein said pair of first and second link conductors are arranged spaced apart from each other in said same plane at an angle formed at the junction between one of said first conductor links with one of said second conductor links, said angle being less than 180°.

9. The contact driver of claim 1 wherein said first and second pair of link conductors are pivotally connected together.

10. The contact driver of claim 1 wherein said second pair of link conductors and said pair of fixed conductors are pivotally connected together.

11. The contact driver of claim 1 further including an insulative support, said fixed contacts being fastened to said fixed support.

12. The contact driver of claim 11 wherein said pair of fixed conductors comprise L-shaped plates.

13. The contact driver of claim 12 wherein said L-shaped plates are fastened to said insulative support.

14. The contact driver of claim 13 wherein said first and second pair of magnetic plates comprise a slot motor.

15. The contact driver of claim 1 wherein said bridging contact includes a slot and wherein said first pair of link conductors is attached to said bridging contact within said slot.

16. A contact driver comprising:

an insulative support;

a pair of fixed contact carriers attached to said support;

a bridging contact connected to one end of a pair of first link conductors;

a second pair of link conductors pivotally connected at one end to said pair of first link conductors and pivotally connected at an opposite end to a pair of fixed conductors;

a current transformer attached to said insulative support and having a primary winding arranged around an apertured core and a secondary winding comprising a metal plate arranged through said apertured core and attached to said pair of fixed conductors and to said insulative support;

a pair of springs, each connected to a junction between said first and second link conductors; and a pair of first magnetic plates, one on each side of said first link conductors and a pair of second magnetic plates, one on each side of said second link conductors to enhance electromagnetic repulsion between said first and second pair of link conductors when an electric current pulse is applied to said primary winding.

17. The contact driver of claim 16 wherein said first and second pair of magnetic plates are attached to said insulative housing.

18. The contact driver of claim 16 wherein said pair of fixed conductors are attached to said insulative housing.

19. The contact driver of claim 16 wherein said bridging contact includes a slot and wherein said one end of each of said link conductors is arranged within said slot.

* * * * *